US010242615B2

(12) United States Patent
Zhang

(10) Patent No.: US 10,242,615 B2
(45) Date of Patent: Mar. 26, 2019

(54) ORGANIC LIGHT-EMITTING DIODE (OLED) DISPLAY DEVICES AND COMPENSATION CIRCUITS OF OLEDS

(71) Applicant: Wuhan China Star Optoelectronics Semiconductor Display Technology Co., Ltd., Wuhan, Hubei (CN)

(72) Inventor: Di Zhang, Guangdong (CN)

(73) Assignee: Wuhan China Star Optoelectronics Semiconductor Display Technology Co., Ltd., Wuhan, Hubei (CN)

( * ) Notice: Subject to any disclaimer, the term of this patent is extended or adjusted under 35 U.S.C. 154(b) by 0 days.

(21) Appl. No.: 15/737,294

(22) PCT Filed: Oct. 20, 2017

(86) PCT No.: PCT/CN2017/106963

§ 371 (c)(1),
(2) Date: Dec. 17, 2017

(65) Prior Publication Data

US 2019/0005874 A1 Jan. 3, 2019

(51) Int. Cl.
*G09G 3/30* (2006.01)
*G09G 3/3225* (2016.01)

(52) U.S. Cl.
CPC ... *G09G 3/3225* (2013.01); *G09G 2300/0819* (2013.01); *G09G 2310/0248* (2013.01); *G09G 2310/061* (2013.01)

(58) Field of Classification Search
CPC ..... G09G 3/30–3/3291; G09G 3/12
See application file for complete search history.

(56) References Cited

U.S. PATENT DOCUMENTS

| | | | | |
|---|---|---|---|---|
| 8,836,618 | B2 | 9/2014 | Liu et al. | |
| 8,963,907 | B2 | 2/2015 | Tsai et al. | |
| 9,508,287 | B2 | 11/2016 | Li et al. | |
| 2006/0022305 | A1* | 2/2006 | Yamashita | G09G 3/2014 257/565 |
| 2009/0174699 | A1* | 7/2009 | Fish | G09G 3/3233 345/214 |
| 2009/0231308 | A1* | 9/2009 | Numao | G09G 3/3233 345/204 |
| 2012/0038605 | A1* | 2/2012 | Han | H05B 33/0896 345/211 |
| 2013/0314305 | A1* | 11/2013 | Liu | G09G 3/32 345/77 |

FOREIGN PATENT DOCUMENTS

| | | | |
|---|---|---|---|
| CN | 104505024 | A | 4/2015 |
| CN | 105489168 | A | 4/2016 |
| KR | 20080001482 | A | 1/2008 |

* cited by examiner

*Primary Examiner* — Sanghyuk Park
(74) *Attorney, Agent, or Firm* — Andrew C. Cheng

(57) ABSTRACT

The present disclosure relates to an organic light-emitting diode (OLED) display device and a compensation circuit of an OLED. The compensation circuit of the OLED includes: a first thin film transistor (TFT), a second TFT, a third TFT, a fourth TFT, a fifth TFT, a sixth TFT, a first capacitor, and a second capacitor. As such, the compensation circuit of the present disclosure only requires the scanning signals and the emission signals, so as to simplify configurations of the circuit, and to reduce costs.

20 Claims, 4 Drawing Sheets

ORGANIC LIGHT-EMITTING DIODE (OLED) DISPLAY DEVICES AND COMPENSATION CIRCUITS OF OLEDS

BACKGROUND

1. Technical Field

The present disclosure relates to an organic light-emitting diode (OLED) display field, and more particularly to an OLED display device and a compensation circuit of an OLED.

2. Description of Related Art

With the evolution of display panels, larger screen, higher resolution, and greater performance are demanded greatly, which results in higher requirement of the manufacturing process. The pixel circuit of the OLEDs may compensate non-uniform screen and device differences by an internal and an external method, so as to achieve a stable, high-quality, and a clearly display performance.

However, the current compensation circuit of the OLEDs requires a plurality of driving signals, resulting in complicated circuit configurations and higher costs.

SUMMARY

The present disclosure relates to a compensation circuit of an organic light-emitting diode (OLED), including: a first thin film transistor (TFT), a second TFT, a third TFT, a fourth TFT, a fifth TFT, a sixth TFT, a first capacitor, and a second capacitor; wherein a first end of the first TFT is configured to receive a first reference voltage, and the first end of the first TFT connects to one end of the first capacitor, a second end of the first TFT and a first end of the second TFT connect to one end of the second capacitor, a third end of the first TFT and a third end of the second TFT connect to a first end of the sixth TFT; a first end of the third TFT and a third end of the fifth TFT connect to the other end of the first capacitor, a second end of the third TFT is configured to receive emission signals, a third end of the third TFT and a third end of the fourth TFT connect to the other end of the second capacitor; a first end of the fourth TFT is configured to receive data signals, a second end of the fourth TFT is configured to receive scanning signals, a first end of the fifth TFT is configured to receive a third reference voltage, a second end of the fifth TFT is configured to receive the scanning signals; a second end of the sixth TFT is configured to receive the emission signals, a third end of the sixth TFT connects to a positive end of the OLED, a negative end of the OLED is configured to receive a second reference voltage; when the compensation circuit is in a driving phase, the scanning signals are configured to be at a low potential, the emission signals are configured to be at a high potential, the third TFT and the sixth TFT are turned off, and the second TFT, the fourth TFT, and the fifth TFT are turned on, a potential of the second end of the first TFT is configured to be Vdd−Vth, wherein Vdd indicates the first reference voltage, Vth indicates a threshold voltage of the first TFT, wherein the first TFT obtains the threshold voltage via the second TFT; when the compensation circuit is in a first driving phase, the scanning signals and the emission signals are configured to be at the low potential, the second TFT, the third TFT, the fourth TFT, the fifth TFT, and the sixth TFT are turned on; the data signals are configured to be the third reference voltage, the second end of the first TFT apply a discharge process toward the OLED to reset the second end of the first TFT.

The present disclosure relates to a compensation circuit of an OLED, including: a first TFT, a second TFT, a third TFT, a fourth TFT, a fifth TFT, a sixth TFT, a first capacitor, and a second capacitor; wherein a first end of the first TFT is configured to receive a first reference voltage, and the first end of the first TFT connects to one end of the first capacitor, a second end of the first TFT and a first end of the second TFT connect to one end of the second capacitor, a third end of the first TFT and a third end of the second TFT connect to a first end of the sixth TFT; a first end of the third TFT and a third end of the fifth TFT connect to the other end of the first capacitor, a second end of the third TFT is configured to receive emission signals, a third end of the third TFT and a third end of the fourth TFT connect to the other end of the second capacitor; a first end of the fourth TFT is configured to receive data signals, a second end of the fourth TFT is configured to receive scanning signals, a first end of the fifth TFT is configured to receive a third reference voltage, a second end of the fifth TFT (T5) is configured to receive the scanning signals; a second end of the sixth TFT is configured to receive the emission signals, a third end of the sixth TFT connects to a positive end of the OLED, a negative end of the OLED is configured to receive a second reference voltage.

The present disclosure relates to an OLED display device, including the compensation circuit described above.

In view of the above, the first end of the first TFT is configured to receive the first reference voltage and connects to one end of the first capacitor. The second end of the first TFT and the first end of the second TFT connect to one end of the second capacitor. The third end of the first TFT and the third end of the second TFT connect to the first end of the sixth TFT. The first end of the third TFT and the third end of the fifth TFT connect to the other end of the first capacitor. The second end of the third TFT is configured to receive the emission signals. The third end of the third TFT and the third end of the fourth TFT connect to the other end of the second capacitor. The first end of the fourth TFT is configured to receive the data signals. The second end of the fourth TFT is configured to receive the scanning signals. The first end of the fifth TFT is configured to receive the third reference voltage. The second end of the fifth TFT is configured to receive the scanning signals. The second end of the sixth TFT is configured to receive the emission signals. The third end of the sixth TFT connects to the positive end of the OLED. The negative end of the OLED is configured to receive the second reference voltage. As such, the compensation circuit of the present disclosure only requires the scanning signals and the emission signals, so as to simplify configurations of the circuit, and to reduce costs.

DETAILED DESCRIPTION

To clarify the purpose, technical solutions, and the advantages of the disclosure, embodiments of the invention will now be described more fully hereinafter with reference to the accompanying drawings, in which embodiments of the invention are shown. The figure and the embodiment described according to figure are only for illustration, and the present disclosure is not limited to these embodiments.

Figure 1:
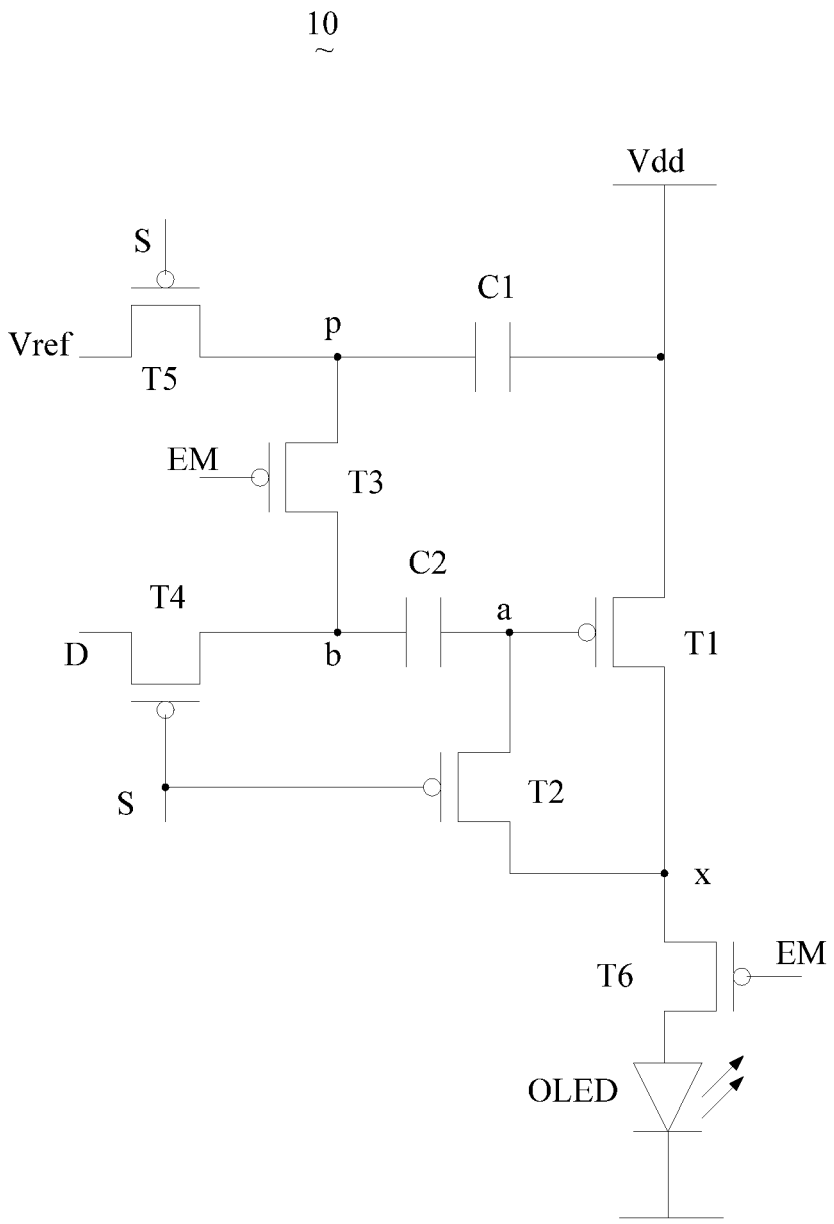
FIG. 1 is a schematic view of a compensation circuit of an OLED in accordance with one embodiment of the present disclosure.

Referring to FIG. 1, the present disclosure relates to a compensation circuit of an organic light-emitting diode (OLED) 10, including: a first thin film transistor (TFT) (T1), a second TFT (T2), a third TFT (T3), a fourth TFT (T4), a fifth TFT (T5), a sixth TFT (T6), a first capacitor C1, and a second capacitor C2.

A first end of the first TFT (T1) is configured to receive a first reference voltage Vdd, and the first end of the first TFT (T1) connects to one end of the first capacitor C1. A second end of the first TFT (T1) and a first end of the second TFT (T2) connect to one end of the second capacitor C2 to form a point "a". A third end of the first TFT (T1) and a third end of the second TFT (T2) respectively connects to a first end of the sixth TFT (T6) to form a point "x".

A first end of the third TFT (T3) and a third end of the fifth TFT (T5) respectively connects to the other end of the first capacitor C1 to form a point "p". A second end of the third TFT (T3) is configured to receive emission signals EM. A third end of the third TFT (T3) and a third end of the fourth TFT (T4) respectively connects to the other end of the second capacitor C2 to form a point "b".

A first end of the fourth TFT (T4) is configured to receive data signals D. A second end of the fourth TFT (T4) is configured to receive scanning signals S. A first end of the fifth TFT (T5) is configured to receive a third reference voltage Vref. A second end of the fifth TFT (T5) is configured to receive the scanning signals S.

A second end of the sixth TFT (T6) is configured to receive the emission signals EM. A third end of the sixth TFT (T6) connects to a positive end of the OLED, and a negative end of the OLED is configured to receive a second reference voltage Vss.

In one example, the first TFT (T1), the second TFT (T2), the third TFT (T3), the fourth TFT (T4), the fifth TFT (T5), and the sixth TFT (T6) may be P-type TFTs. Wherein a first end of the P-type TFT is configured to be a source, a second end of the P-type TFT is configured to be a gate, and a third end of the P-type TFT is configured to be a drain.

In another example, the first TFT (T1), the second TFT (T2), the third TFT (T3), the fourth TFT (T4), the fifth TFT (T5), and the sixth TFT (T6) may be N-type TFTs.

In view of the above, the compensation circuit 10 of the present disclosure only requires the scanning signals S and the emission signals EM, as such, configurations of the circuit may be simplified, and costs may be reduced.

Figure 2:
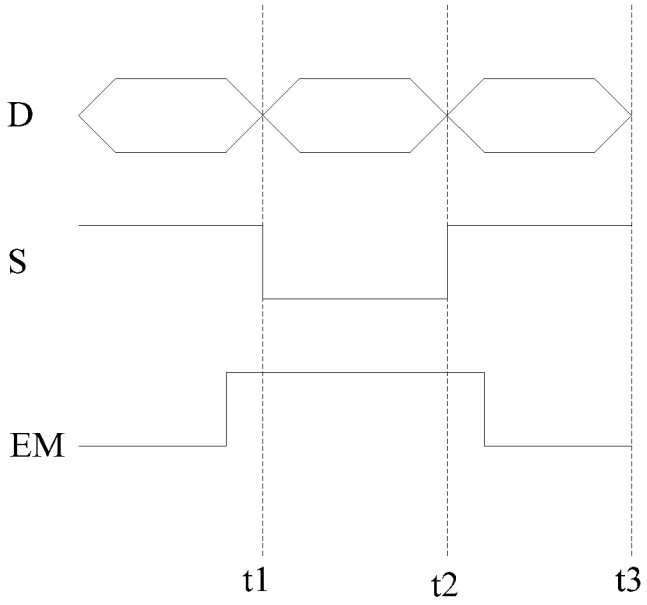
FIG. 2 is a timing diagram of data signals, scanning signals, and emission signals shown in FIG. 1.

As shown in FIG. 2, the compensation circuit 10 may include a driving phase and an emission phase. The driving phase is configured within a time-range from (T1) to (T2), and the emission phase is configured within a time-range from (T2) to (T3).

Figure 3:
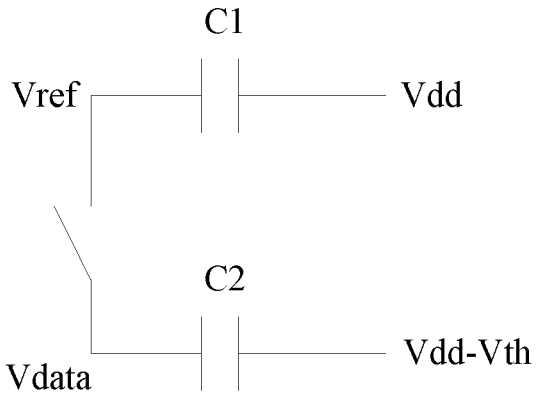
FIG. 3 is a diagram illustrating a state of a first capacitor and a second capacitor, as shown in FIG. 1, in a driving phase.

When the compensation circuit 10 is in the driving phase, i.e., within the time-range from (T1) to (T2), the scanning signals S are configured to be at a low potential, and the emission signals EM are configured to be at a high potential. As such, the third TFT (T3) and the sixth TFT (T6) are turned off, and the second TFT (T2), the fourth TFT (T4), and the fifth TFT (T5) are turned on. The second end of the first TFT (T1) may obtain a threshold voltage Vth via the second TFT (T2). As such, a potential of the second end of the first TFT (T1) is configured to be as:

$$Vdd-Vth \tag{1}$$

Wherein "Vdd" indicates the first reference voltage Vdd, and "Vth" indicates the threshold voltage Vth of the first TFT (T1) obtaining from the second TFT (T2). A state of the first capacitor C1 and the capacitor C2 is shown in FIG. 3.

Figure 4:
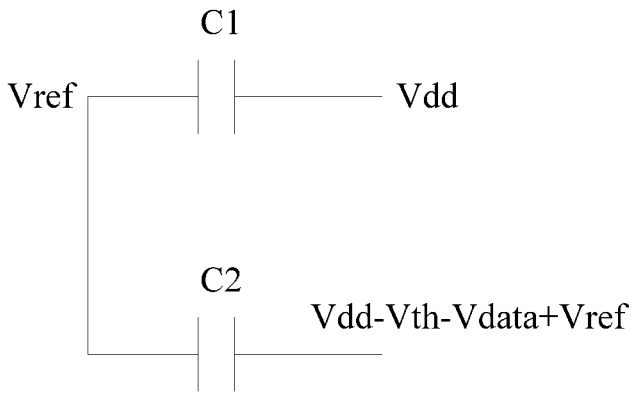
FIG. 4 is a diagram illustrating a state of the first capacitor and the second capacitor, as shown in FIG. 1, in an emission phase.

When the compensation circuit 10 is in the emission phase, i.e., within the time-range from (T2) to (T3), the scanning signals S are configured to be at the high potential, and the emission signals EM are configured to be at the low potential. As such, the third TFT (T3) and the sixth TFT (T6) are turned on, and the second TFT (T2), the fourth TFT (T4), and the fifth TFT (T5) are turned off. The point "b" may connect with the point "p" via the third TFT (T3), and a potential of the point "b" is configured to be a third reference voltage Vref. The state of the first capacitor C1 and the capacitor C2 are shown in FIG. 4. The second capacitor C2 may conduct a coupling process, and a potential of the second end of the first TFT (T1) is configured to be as:

$$Vdd-Vth-V\text{data}+V\text{ref} \tag{2}$$

Wherein "Vdata" indicates a voltage of the data signals D, and "Vref" indicates the third reference voltage Vref.

A voltage Vgs between the gate and the source of the first TFT (T1) is configured to be as:

$$Vth+V\text{data}-V\text{ref} \tag{3}$$

The OLED satisfies the following equation:

$$I=k(V\text{data}-V\text{ref})\hat{}2 \tag{4}$$

Wherein "k" is a constant.

As such, the compensation circuit 10 may conduct a compensation process on the threshold voltage and a writing process with respect to the data signals D within one driving phase.

Figure 5:
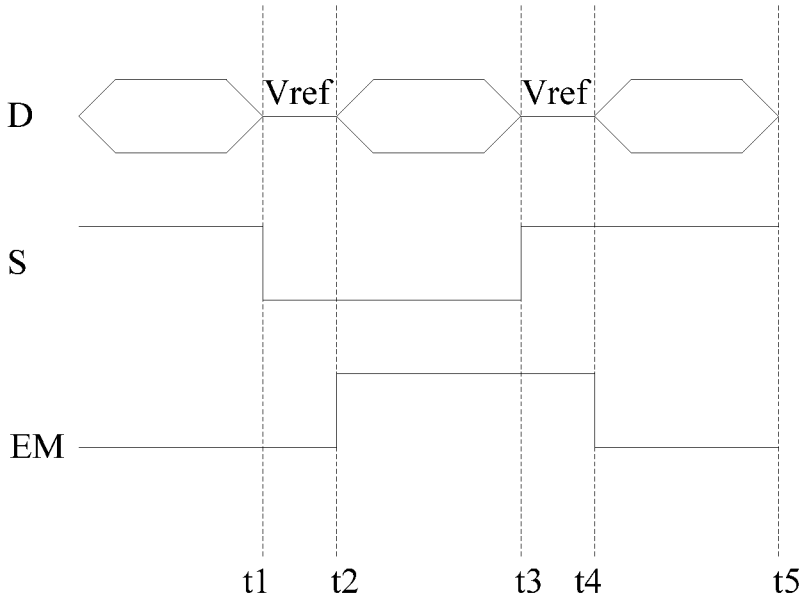
FIG. 5 s a timing diagram of the data signals, the scanning signals, and the emission signals in accordance with another embodiment of the present disclosure.

In another aspect, as shown in FIG. 5, the driving phase may further include a first driving phase and a second driving phase. The first driving phase is configured within the time-range from (T1) to (T2), the second driving phase is configured within the time-range from (T2) to (T3), and the emission phase is configured within a time-range from (T4) to (T5). As such, the scanning signals S and the emission signals EM are separated from each other. The data signals D may include direct current (DC) signals of the third reference voltage Vref.

When the compensation circuit 10 is in the first driving phase, i.e., within the time-range from (T1) to (T2), the scanning signals S and the emission signals EM are configured to be at the low potential, as such, the second TFT (T2), the third TFT (T3), the fourth TFT (T4), the fifth TFT (T5), and the sixth TFT (T6) are turned on. The data signals D are configured to be the third reference voltage Vref, that is, the voltage of the data signals D are equal to the third reference voltage Vref. The second end of the first TFT (T1) may conduct a discharge process on the OLED, that is, the second end of the first TFT (T1) may apply the discharge process by the second reference voltage Vss toward the OLED to reset the second end of the first TFT (T1), so as to prepare for obtaining the threshold voltage Vth and conducting the writing process with respect to the data signals D in the second driving phase.

When the compensation circuit 10 is in the second driving phase, i.e., within the time-range from (T2) to (T3), the scanning signals S are configured to be at the low potential, and the emission signals EM are configured to be at the high potential. As such, the third TFT (T3) and the sixth TFT (T6) are turned off, and the second TFT (T2), the fourth TFT (T4), and the fifth TFT (T5) are turned on. The second end of the first TFT (T1) may obtain the threshold voltage Vth via the second TFT (T2). As such, the potential of the second end of the first TFT (T1) is configured to be as (Vdd−Vth). Wherein "Vdd" indicates the first reference voltage Vdd, and "Vth" indicates the threshold voltage Vth of the first TFT (T1) obtaining from the second TFT (T2). The state of the first capacitor C1 and the capacitor C2 are shown in FIG. 3.

Within the time-range from (T3) to (T4), the scanning signals S and the emission signals EM are configured to be at the high potential. As such, the first TFT (T1), the second TFT (T2), the third TFT (T3), the fourth TFT (T4), the fifth TFT (T5), and the sixth TFT (T6) are turned off.

When the compensation circuit 10 is in the emission phase, i.e., within the time-range from (T4) to (T5), the scanning signals S are configured to be at the high potential, and the emission signals EM are configured to be at the low potential. As such, the third TFT (T3) and the sixth TFT (T6) are turned on, and the second TFT (T2), the fourth TFT (T4), and the fifth TFT (T5) are turned off. The point "b" may connect with the point "p" via the third TFT (T3), and the potential of the point "b" is configured to be the third reference voltage Vref. The state of the first capacitor C1 and the capacitor C2 are shown in FIG. 4. The second capacitor C2 may conduct the coupling process, and the potential of the second end of the first TFT (T1) is configured to be as (Vdd−Vth−Vdata+Vref). Wherein "Vdd" indicates the first reference voltage Vdd, "Vth" indicates the threshold voltage Vth, "Vdata" indicates the voltage of the data signals D, and "Vref" indicates the third reference voltage Vref.

Figure 6:
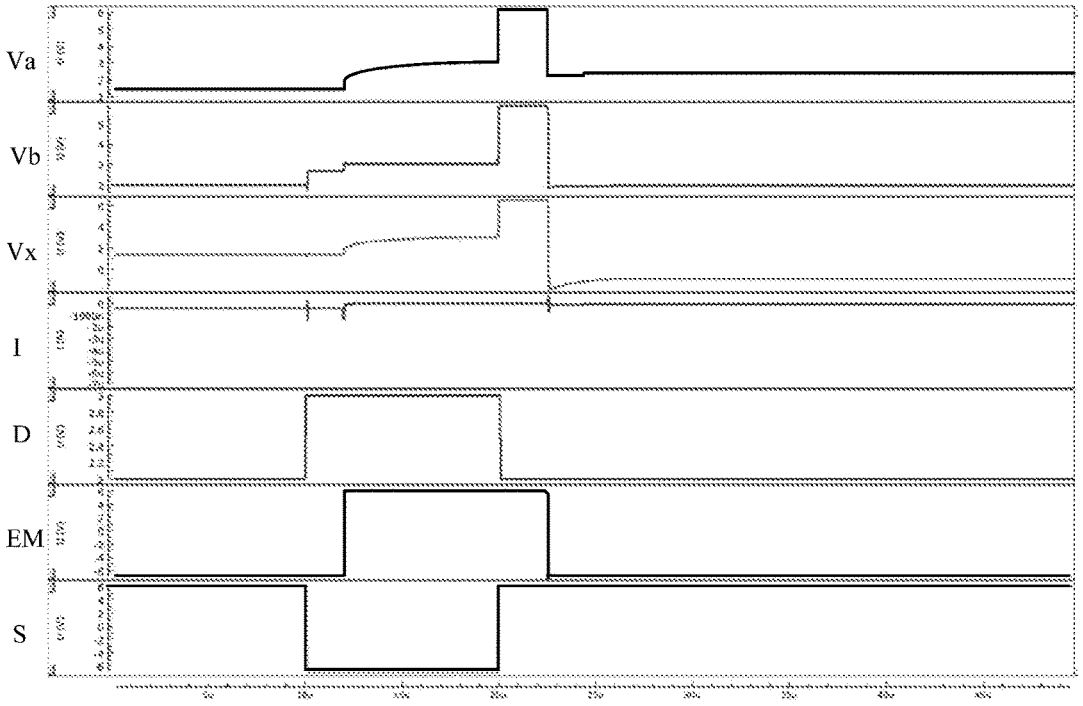
FIG. 6 is a simulation diagram of FIG. 5.

As shown in FIG. 6, a simulation test is conducted on the compensation circuit 10. Wherein "Va" indicates a potential of the point "a", "Vb" indicates the potential of the point "b", "Vx" indicates a potential of the point "x", "I" indicates a current of the OLED, "D" indicates the data signals D, "S" indicates the scanning signals S, and "EM" indicates the emission signals.

The second end of the first TFT (T1) may be reset to prevent the data signals D at a previous level from being too high, which may result in the threshold voltage cannot be obtained by the second end of the first TFT (T1). So as to improve stability of the compensation circuit.

Figure 7:
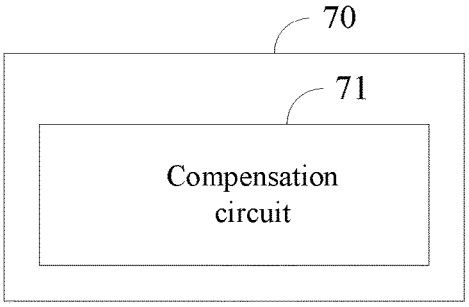
FIG. 7 is a schematic view of an OLED display device in accordance with one embodiment of the present disclosure.

The present disclosure further relates to an OLED display device, as shown in FIG. 7. The display device 70 may include the compensation circuit 71, wherein the compensation circuit 71 may be the compensation circuit described in above, and may not be described again.

In view of the above, the first end of the first TFT is configured to receive the first reference voltage and connects to one end of the first capacitor. The second end of the first TFT and the first end of the second TFT connect to one end of the second capacitor. The third end of the first TFT and the third end of the second TFT connect to the first end of the sixth TFT. The first end of the third TFT and the third end of the fifth TFT connect to the other end of the first capacitor. The second end of the third TFT is configured to receive the emission signals. The third end of the third TFT and the third end of the fourth TFT connect to the other end of the second capacitor. The first end of the fourth TFT is configured to receive the data signals. The second end of the fourth TFT is configured to receive the scanning signals. The first end of the fifth TFT is configured to receive the third reference voltage. The second end of the fifth TFT is configured to receive the scanning signals. The second end of the sixth TFT is configured to receive the emission signals. The third end of the sixth TFT connects to the positive end of the OLED. The negative end of the OLED is configured to receive the second reference voltage. As such, the compensation circuit of the present disclosure only requires the scanning signals and the emission signals, so as to simplify configurations of the circuit, and to reduce costs.

The above description is merely the embodiments in the present disclosure, the claim is not limited to the description thereby. The equivalent structure or changing of the process of the content of the description and the figures, or to implement to other technical field directly or indirectly should be included in the claim.

What is claimed is:

1. A compensation circuit of an organic light-emitting diode (OLED), comprising:

a first thin film transistor (TFT), a second TFT, a third TFT, a fourth TFT, a fifth TFT, a sixth TFT, a first capacitor, and a second capacitor;

wherein a first end of the first TFT is configured to receive a first reference voltage, and the first end of the first TFT connects to one end of the first capacitor, a second end of the first TFT and a first end of the second TFT connect to one end of the second capacitor, a third end of the first TFT and a third end of the second TFT connect to a first end of the sixth TFT;

a first end of the third TFT and a third end of the fifth TFT connect to the other end of the first capacitor, a second end of the third TFT is configured to receive emission signals, a third end of the third TFT and a third end of the fourth TFT connect to the other end of the second capacitor;

a first end of the fourth TFT is configured to receive data signals, a second end of the fourth TFT is configured to receive scanning signals, a first end of the fifth TFT is configured to receive a third reference voltage, a second end of the fifth TFT is configured to receive the scanning signals;

a second end of the sixth TFT is configured to receive the emission signals, a third end of the sixth TFT connects to a positive end of the OLED, and a negative end of the OLED is configured to receive a second reference voltage;

when the compensation circuit is in a driving phase, the scanning signals are configured to be at a low potential, the emission signals are configured to be at a high potential, the third TFT and the sixth TFT are turned off, and the second TFT, the fourth TFT, and the fifth TFT are turned on, a potential of the second end of the first TFT is configured to be Vdd−Vth, wherein Vdd indicates the first reference voltage, Vth indicates a threshold voltage of the first TFT, and the first TFT obtains the threshold voltage via the second TFT;

when the compensation circuit is in a first driving phase, the scanning signals and the emission signals are configured to be at the low potential, the second TFT, the third TFT, the fourth TFT, the fifth TFT, and the sixth TFT are turned on;

the data signals are configured to be the third reference voltage, the second end of the first TFT apply a discharge process toward the OLED to reset the second end of the first TFT.

2. The compensation circuit of the OLED according to claim 1, wherein when the compensation circuit is in a second driving phase, the scanning signals are configured to be at the low potential, and the emission signals are configured to be at the high potential, the third TFT and the sixth TFT are turned off, and the second TFT, the fourth TFT, and the fifth TFT are turned on;

the potential of the second end of the first TFT is configured to be Vdd−Vth.

3. A compensation circuit of an OLED, comprising:

a first TFT, a second TFT, a third TFT, a fourth TFT, a fifth TFT, a sixth TFT, a first capacitor, and a second capacitor;

wherein a first end of the first TFT is configured to receive a first reference voltage, and the first end of the first TFT connects to one end of the first capacitor, a second end of the first TFT and a first end of the second TFT connect to one end of the second capacitor, a third end of the first TFT and a third end of the second TFT connect to a first end of the sixth TFT;

a first end of the third TFT and a third end of the fifth TFT connect to the other end of the first capacitor, a second end of the third TFT is configured to receive emission signals, a third end of the third TFT and a third end of the fourth TFT connect to the other end of the second capacitor;

a first end of the fourth TFT is configured to receive data signals, a second end of the fourth TFT is configured to receive scanning signals, a first end of the fifth TFT is configured to receive a third reference voltage, a second end of the fifth TFT (T5) is configured to receive the scanning signals;

a second end of the sixth TFT is configured to receive the emission signals, a third end of the sixth TFT connects to a positive end of the OLED, and a negative end of the OLED is configured to receive a second reference voltage.

4. The compensation circuit of the OLED according to claim 3, wherein when the compensation circuit is in a driving phase, the scanning signals are configured to be at a low potential, the emission signals are configured to be at a high potential, the third TFT and the sixth TFT are turned off, and the second TFT, the fourth TFT, and the fifth TFT are turned on;

a potential of the second end of the first TFT is configured to be Vdd−Vth, wherein Vdd indicates the first reference voltage, Vth indicates a threshold voltage of the first TFT, and the first TFT obtains the threshold voltage via the second TFT.

5. The compensation circuit of the OLED according to claim 3, wherein when the compensation circuit is in a first driving phase, the scanning signals and the emission signals are configured to be at the low potential, the second TFT, the third TFT, the fourth TFT, the fifth TFT, and the sixth TFT are turned on;

the data signals are configured to be the third reference voltage, the second end of the first TFT apply a discharge process toward the OLED to reset the second end of the first TFT.

6. The compensation circuit of the OLED according to claim 5, wherein when the compensation circuit is in a second driving phase, the scanning signals are configured to be at the low potential, and the emission signals are configured to be at the high potential, the third TFT and the sixth TFT are turned off, and the second TFT, the fourth TFT, and the fifth TFT are turned on;

a potential of the second end of the first TFT is configured to be Vdd−Vth.

7. The compensation circuit of the OLED according to claim 6, wherein the scanning signals and the emission signals are separated from each other, and the data signals further include direct current (DC) signals of the third reference voltage.

8. The compensation circuit of the OLED according to claim 6, wherein when the compensation circuit is in an emission phase, the scanning signals are configured to be at the high potential, and the emission signals are configured to be at the low potential, the third TFT and the sixth TFT are turned on, and the second TFT, the fourth TFT, and the fifth TFT are turned off;

the potential of the second end of the first TFT is configured to be Vdd−Vth−Vdata+Vref, wherein Vdd indicates the first reference voltage, Vth indicates the threshold voltage, Vdata indicates a voltage of the data signals, and Vref indicates the third reference voltage.

9. The compensation circuit of the OLED according to claim 8, wherein a current of the OLED satisfies the equation:

$$I=k(V\text{data}-V\text{ref})^2;$$

wherein I is the current of the OLED, and k is a constant.

10. The compensation circuit of the OLED according to claim 3, wherein the first TFT, the second TFT, the third TFT, the fourth TFT, the fifth TFT, and the sixth TFT are P-type TFTs.

11. The compensation circuit of the OLED according to claim 3, wherein the first TFT, the second TFT, the third TFT, the fourth TFT, the fifth TFT, and the sixth TFT are N-type TFTs.

12. An OLED display device, comprising:

a compensation circuit comprising:

a first TFT, a second TFT, a third TFT, a fourth TFT, a fifth TFT, a sixth TFT, a first capacitor, and a second capacitor;

wherein a first end of the first TFT is configured to receive a first reference voltage, and the first end of the first TFT connects to one end of the first capacitor, a second end of the first TFT and a first end of the second TFT connect to one end of the second capacitor, a third end of the first TFT and a third end of the second TFT connect to a first end of the sixth TFT;

a first end of the third TFT and a third end of the fifth TFT connect to the other end of the first capacitor, a second end of the third TFT is configured to receive emission signals, a third end of the third TFT and a third end of the fourth TFT connect to the other end of the second capacitor;

a first end of the fourth TFT is configured to receive data signals, a second end of the fourth TFT is configured to receive scanning signals, a first end of the fifth TFT is configured to receive a third reference voltage, a second end of the fifth TFT is configured to receive the scanning signals;

a second end of the sixth TFT is configured to receive the emission signals, a third end of the sixth TFT connects to a positive end of the OLED, a negative end of the OLED is configured to receive a second reference voltage.

13. The compensation circuit of the OLED according to claim 12, wherein when the compensation circuit is in a driving phase, the scanning signals are configured to be at a low potential, the emission signals are configured to be at a high potential, the third TFT and the sixth TFT are turned off, and the second TFT, the fourth TFT, and the fifth TFT are turned on;

a potential of the second end of the first TFT is configured to be Vdd−Vth, wherein Vdd indicates the first reference voltage, and Vth indicates a threshold voltage of the first TFT, and the first TFT obtains the threshold voltage via the second TFT.

14. The compensation circuit of the OLED according to claim 12, wherein when the compensation circuit is in a first driving phase, the scanning signals and the emission signals are configured to be at the low potential, the second TFT, the third TFT, the fourth TFT, the fifth TFT, and the sixth TFT are turned on;

the data signals are configured to be the third reference voltage, the second end of the first TFT apply a discharge process toward the OLED to reset the second end of the first TFT.

15. The compensation circuit of the OLED according to claim 14, wherein when the compensation circuit is in a second driving phase, the scanning signals are configured to be at the low potential, and the emission signals are configured to be at the high potential, the third TFT and the sixth TFT are turned off, and the second TFT, the fourth TFT, and the fifth TFT are turned on;

a potential of the second end of the first TFT is configured to be Vdd−Vth.

16. The compensation circuit of the OLED according to claim 15, wherein the scanning signals and the emission signals are separated from each other, and the data signals further include DC signals of the third reference voltage.

17. The compensation circuit of the OLED according to claim 15, wherein when the compensation circuit is in an emission phase, the scanning signals are configured to be at the high potential, and the emission signals are configured to be at the low potential, the third TFT and the sixth TFT are turned on, and the second TFT, the fourth TFT, and the fifth TFT are turned off;

the potential of the second end of the first TFT is configured to be Vdd−Vth−Vdata+Vref, wherein Vdd indicates the first reference voltage, Vth indicates the threshold voltage, Vdata indicates a voltage of the data signals, and Vref indicates the third reference voltage.

18. The compensation circuit of the OLED according to claim 17, wherein a current of the OLED satisfies equation:

$$I=k(V\text{data}-V\text{ref})^2;$$

wherein I is the current of the OLED, and k is a constant.

19. The compensation circuit of the OLED according to claim 12, wherein the first TFT, the second TFT, the third TFT, the fourth TFT, the fifth TFT, and the sixth TFT are P-type TFTs.

20. The compensation circuit of the OLED according to claim 12, wherein the first TFT, the second TFT, the third TFT, the fourth TFT, the fifth TFT, and the sixth TFT are N-type TFTs.

* * * * *